US011927380B2

(12) United States Patent
Kawano et al.

(10) Patent No.: US 11,927,380 B2
(45) Date of Patent: Mar. 12, 2024

(54) REFRIGERATION APPARATUS

(71) Applicant: DAIKIN INDUSTRIES, LTD., Osaka (JP)

(72) Inventors: Satoshi Kawano, Osaka (JP); Daiki Onozato, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/328,120

(22) Filed: Jun. 2, 2023

(65) Prior Publication Data

US 2023/0304715 A1 Sep. 28, 2023

Related U.S. Application Data

(63) Continuation of application No. PCT/JP2021/043649, filed on Nov. 29, 2021.

(30) Foreign Application Priority Data

Dec. 2, 2020 (JP) ..... 2020-200370

(51) Int. Cl.
*F25B 49/02* (2006.01)
*F25B 13/00* (2006.01)

(52) U.S. Cl.
CPC ..... *F25B 49/022* (2013.01); *F25B 13/00* (2013.01); *F25B 2600/0253* (2013.01); *F25B 2700/21161* (2013.01); *F25B 2700/21172* (2013.01); *F25B 2700/21173* (2013.01)

(58) Field of Classification Search
CPC ..... F25B 49/022; F25B 13/00; F25B 2600/0253; F25B 2700/21161; F25B 2700/21173
See application file for complete search history.

(56) References Cited

FOREIGN PATENT DOCUMENTS

| | | | | |
|---|---|---|---|---|
| CN | 108224624 | A | * | 6/2018 |
| EP | 2469201 | A2 | * | 6/2012 |
| EP | 3705808 | B1 | | 8/2022 |
| JP | H07218003 | A | * | 8/1995 |
| JP | 2017-40396 | A | | 2/2017 |
| JP | 2017-137044 | A | | 8/2017 |
| JP | 2019-20090 | A | | 2/2019 |

(Continued)

OTHER PUBLICATIONS

Liu et al., Control Method and Device for Cooling Water Machine System Jun. 29, 2018, CN108224624A, Whole Document (Year: 2018).*

(Continued)

*Primary Examiner* — Larry L Furdge

(74) *Attorney, Agent, or Firm* — Osha Bergman Watanabe & Burton LLP

(57) ABSTRACT

A refrigeration apparatus includes: a compressor; a first heat exchanger that allows a first heating medium compressed by the compressor to flow therein and to radiate heat of the first heating medium; a second heat exchanger that allows the first heating medium having passed the first heat exchanger and a second heating medium cooling a cooling target to flow therein, and causes heat exchange between the first heating medium and the second heating medium; a first temperature sensor that detects temperature of the second heating medium in the second heat exchanger; and a control device that controls an operating frequency of the compressor.

6 Claims, 6 Drawing Sheets

(56) References Cited

FOREIGN PATENT DOCUMENTS

| | | | |
|---|---|---|---|
| JP | 2019-173986 | A | 10/2019 |
| JP | 6601472 | B2 | 11/2019 |

OTHER PUBLICATIONS

Ito, Control System for Refrigerator, Aug. 18, 1995, JPH07218003A, Whole Document (Year: 1995).*
International Search Report issued in corresponding International Application No. PCT/JP2021/043649 dated Dec. 28, 2021 (2 pages).
Written Opinion issued in corresponding International Application No. PCT/JP2021/043649 dated Dec. 28, 2021 (3 pages).
Decision to Grant a Patent issued in corresponding Japanese Application No. 2020-200370 dated Dec. 21, 2021 (5 pages).
English translation of International Preliminary Report on Patentability issued in corresponding International Application No. PCT/JP2021/043649 dated Jun. 15, 2023 (5 pages).

* cited by examiner

REFRIGERATION APPARATUS

TECHNICAL FIELD

The present disclosure relates to a refrigeration apparatus.

BACKGROUND

PATENT LITERATURE 1 discloses a refrigeration apparatus including a compressor configured to compress a refrigerant, a first heat exchanger allowing the refrigerant to flow therein, and a second heat exchanger allowing the refrigerant and water to flow therein and configured to cause heat exchange between the refrigerant and the water. The water is caused to circulate in a water circuit by a pump, and cools a cooling target during the circulation (see PATENT LITERATURE 1 or the like).

PATENT LITERATURE

PATENT LITERATURE 1: Japanese Laid-Open Patent Publication No. 2019-20090

SUMMARY

The present disclosure provides a refrigeration apparatus including:

a compressor;

a first heat exchanger configured to allow a first heating medium compressed by the compressor to flow therein and radiate heat of the first heating medium;

a second heat exchanger configured to allow the first heating medium having passed the first heat exchanger and a second heating medium provided to cool a cooling target to flow therein and cause heat exchange between the first heating medium and the second heating medium;

a first temperature sensor configured to detect temperature of the second heating medium in the second heat exchanger; and a control device configured to control an operating frequency of the compressor; in which the control device effects a first operating mode for changing the operating frequency by first acceleration upon satisfaction of a first condition where increasing temperature per predetermined time of the second heating medium in the second heat exchanger is equal to or less than a first threshold, and effects a second operating mode for changing the operating frequency by second acceleration higher than the first acceleration upon satisfaction of a second condition where the increasing temperature per predetermined time of the second heating medium in the second heat exchanger exceeds the first threshold.

DETAILED DESCRIPTION

A refrigeration apparatus according to one or more embodiments will be described in detail hereinafter with reference to the accompanying drawings.

Figure 1:
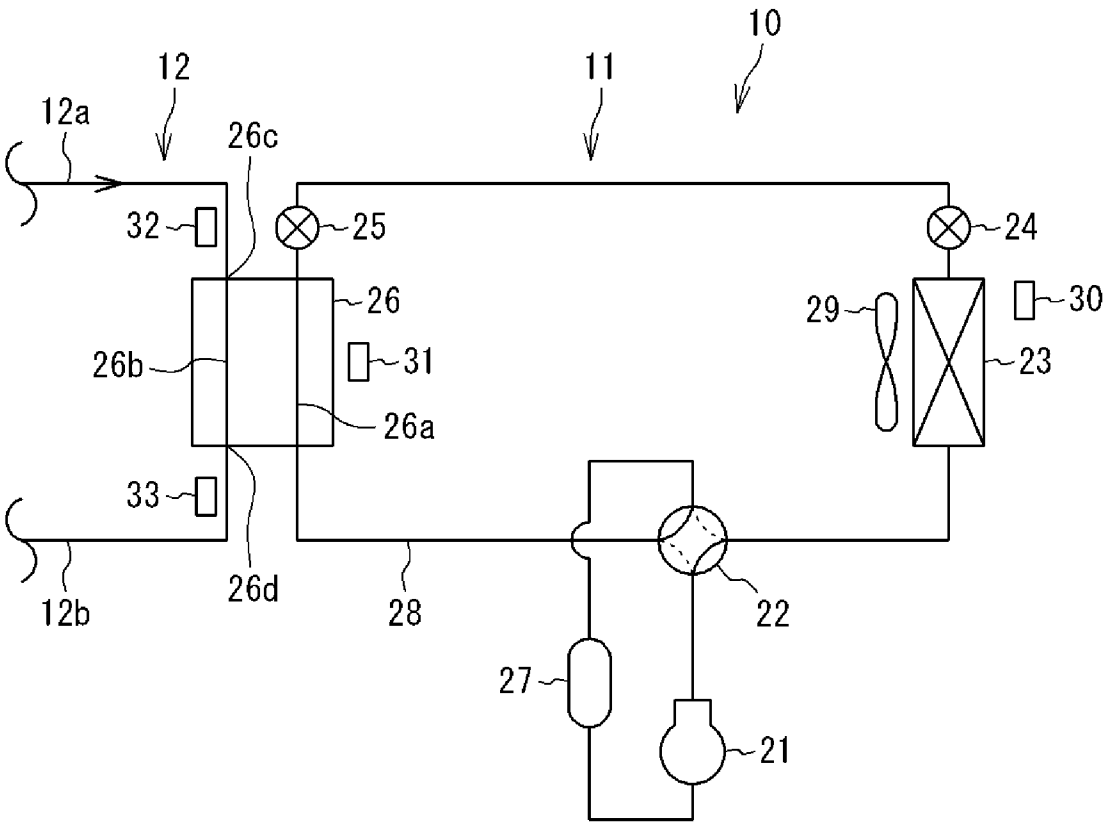
FIG. 1 is a refrigerant circuit diagram of a refrigeration apparatus according to one or more embodiments of the present disclosure.

FIG. 1 is a refrigerant circuit diagram of a refrigeration apparatus according to one or more embodiments of the present disclosure.

One or more embodiments provide a refrigeration apparatus 10 functioning as a chiller apparatus. The chiller apparatus 10 includes a refrigerant circuit 11 configured to execute refrigeration cycle operation. The refrigerant circuit 11 cools water serving as a heating medium (second heating medium). Water thus cooled circulates in a water circuit 12 provided in cooling equipment, and cools a cooling target during the circulation.

The refrigerant circuit 11 includes a compressor 21, a four-way switching valve 22, a first heat exchanger 23, a first expansion valve 24, a second expansion valve 25, a second heat exchanger 26, an accumulator 27, and a refrigerant pipe 28 connecting these components. The refrigerant pipe 28 allows a refrigerant serving as a first heating medium to flow therein.

The compressor 21 sucks a low-pressure gas refrigerant and discharges a high-pressure gas refrigerant. The compressor 21 includes a motor having a number of operating revolutions adjustable in accordance with inverter control. The compressor 21 is of a variable capacity type (performance variable type) having capacity (performance) variable in accordance with inverter control of the motor.

The four-way switching valve 22 reverses a refrigerant flow in the refrigerant pipe 28, and switchingly supplies one of the first heat exchanger 23 and the second heat exchanger 26 with the refrigerant discharged from the compressor 21. The chiller apparatus 10 can thus switchingly cool or heat water circulating in the water circuit 12. The chiller apparatus 10 according to one or more embodiments may alternatively be configured to only cool water. The following description refers to a case where the four-way switching valve 22 causes the refrigerant discharged from the compressor 21 to flow to the first heat exchanger 23 and the chiller apparatus 10 cools water.

The first expansion valve 24 and the second expansion valve 25 are each constituted by an electrically powered expansion valve configured to adjust a refrigerant flow rate. Particularly when the chiller apparatus 10 cools water, the first expansion valve 24 is in a fully opened state, and the second expansion valve 25 has an opening degree controlled by a control device 50 to be described later and adjusts the refrigerant flow rate.

The first heat exchanger 23 is constituted by a heat exchanger of a cross-fin tube type, a microchannel type, or the like. The first heat exchanger 23 causes heat exchange between outdoor air and the refrigerant. When the chiller apparatus 10 cools water, the first heat exchanger 23 functions as a condenser (radiator) for the refrigerant, and radiates heat of the refrigerant. The chiller apparatus 10 further includes a fan 29 configured to supply the first heat exchanger 23 with outdoor air, and an outdoor air temperature sensor 30 configured to detect outdoor air temperature.

The second heat exchanger 26 is exemplarily constituted by a plate heat exchanger. The second heat exchanger 26 includes a refrigerant flow path 26*a* and a water flow path 26*b*. The refrigerant flow path 26*a* is connected with the refrigerant pipe 28 of the refrigerant circuit 11. The water flow path 26*b* is connected with the water circuit 12 in the cooling equipment. The second heat exchanger 26 causes heat exchange between the refrigerant flowing in the refrigerant flow path 26*a* and water flowing in the water flow path 26*b*. When the chiller apparatus 10 cools water, the second heat exchanger 26 functions as an evaporator for the refrigerant to evaporate the refrigerant.

The second heat exchanger 26 includes a water inlet 26*c* connected with an inlet pipe 12*a* of the water circuit 12 in the cooling equipment, and a water outlet 26*d* connected with an outlet pipe 12*b* of the water circuit 12. The water circuit 12 in the cooling equipment has a water circulation path including the inlet pipe 12*a* and the outlet pipe 12*b* and provided with a pump configured to cause water to flow, a tank configured to store water, and a cooler (a refrigerating chamber, a freezing chamber, or the like) serving as the cooling target.

The accumulator 27 separates the refrigerant into a gas phase refrigerant and a liquid phase refrigerant, and causes the compressor 21 to suck only the gas phase refrigerant. The accumulator 27 inhibits the compressor 21 from sucking the liquid phase refrigerant, to prevent trouble of the compressor 21.

The chiller apparatus 10 includes a refrigerant temperature sensor 31, an inlet temperature sensor 32, an outlet temperature sensor 33, and the like. The refrigerant temperature sensor 31 detects temperature of the refrigerant flowing in the refrigerant flow path 26*a* of the second heat exchanger 26. When the second heat exchanger 26 functions as an evaporator, the refrigerant temperature sensor 31 detects evaporation temperature of the refrigerant.

The inlet temperature sensor 32 detects temperature of water flowing into the water flow path 26*b* of the second heat exchanger 26. In other words, the inlet temperature sensor 32 detects temperature of water having cooled the cooling target in the water circuit 12 provided in the cooling equipment. The outlet temperature sensor 33 detects temperature of water flowing out of the water flow path 26*b* of the second heat exchanger 26. In other words, the outlet temperature sensor 33 detects temperature of water cooled in the second heat exchanger 26 and supplied to the water circuit 12.

Figure 2:
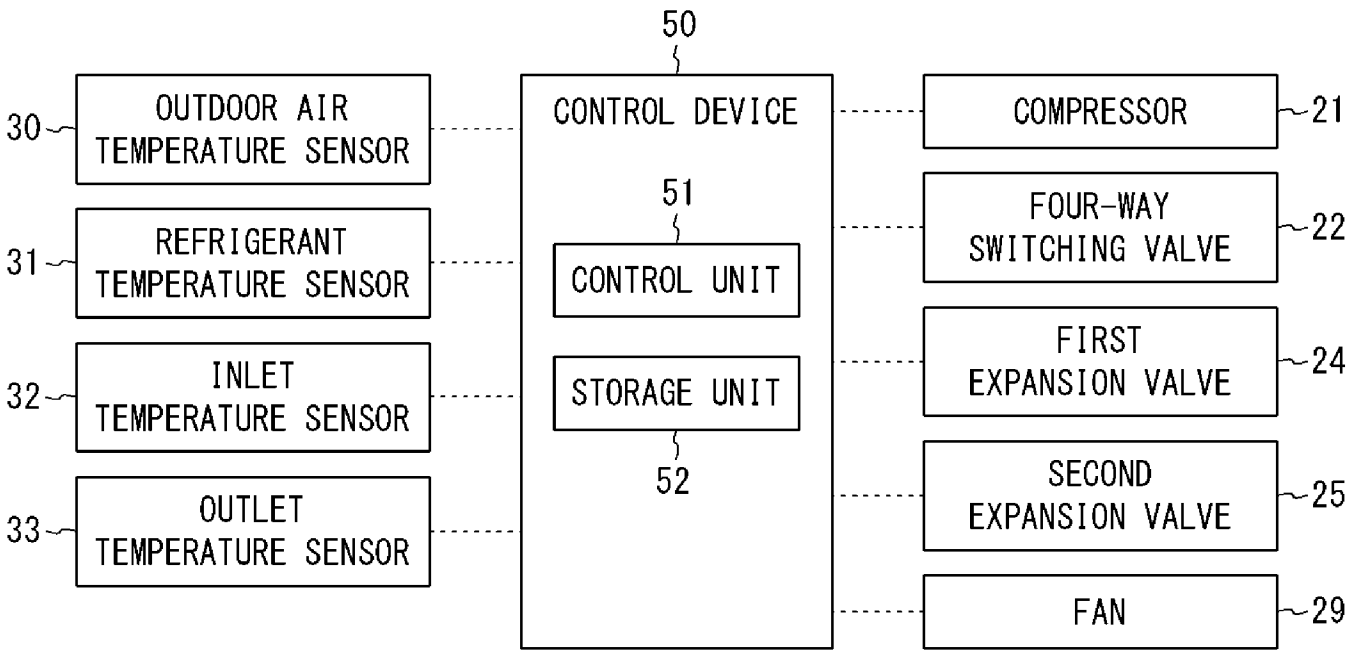
FIG. 2 is a block diagram depicting a configuration of a control device.

FIG. 2 is a block diagram depicting a configuration of the control device 50.

The chiller apparatus 10 includes the control device 50. The control device 50 includes a control unit 51 having an operation function, and a storage unit 52 such as a RAM or a ROM configured to store data. The control unit 51 executes a control program stored in the storage unit 52 to achieve a predetermined function. Specifically, the control device 50 controls behavior of drive components provided in the chiller apparatus 10, such as the compressor 21, the four-way switching valve 22, the first expansion valve 24, the second expansion valve 25, and the fan 29. The control device 50 receives information detected by the outdoor air temperature sensor 30, the refrigerant temperature sensor 31, the inlet temperature sensor 32, and the outlet temperature sensor 33. The control device 50 controls behavior of the drive components with reference to the detected information. Examples of the control unit 51 include a CPU, a GPU, an ASIC, and an FPGA, each of which has only to have an operation function, without particular limitation.

[Relationship Between Temperature Change of Cooling Target and Temperature Change of Second Heating Medium]

Figure 3:
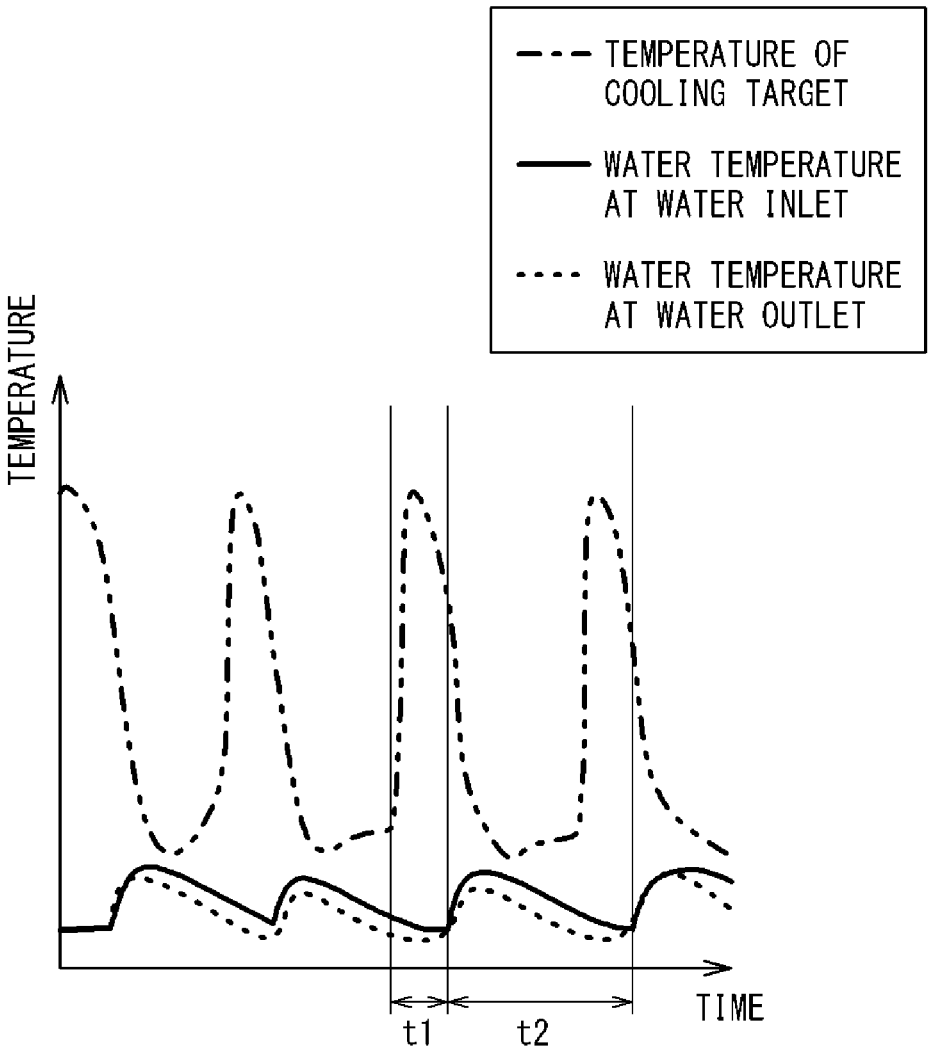
FIG. 3 is a graph indicating temperature change of a cooling target and temperature change of a second refrigerant.

FIG. 3 is a graph indicating a relationship between temperature change of the cooling target and temperature change of the second heating medium.

FIG. 3 exemplifies a case where temperature of the cooling target (e.g. temperature of the cooler in the cooling equipment) increases and decreases periodically and repetitively. Such temperature change is caused in a case where the cooling equipment is activated and stops repetitively at predetermined time intervals, or a case where an object to be cooled is replaced at predetermined time intervals. Meanwhile, temperature of water in the water circuit 12 provided in the cooling equipment increases along with temperature increase of the cooling target. Specifically, temperature of water at each of the water inlet 26*c* and the water outlet 26*d* of the second heat exchanger 26 increases after temperature increase of the cooling target. FIG. 3 indicates such time delay t1. The time delay t1 is caused because water having cooled the cooling target passes the tank and the like provided on the water circuit 12 and then returns to the second heat exchanger 26, and temperature increase of the cooling target is not readily reflected on temperature of water at the water inlet 26*c* and the water outlet 26*d* of the second heat exchanger 26.

[Compressor Control by Control Device 50]

As indicated in FIG. 3, the control device 50 according to one or more embodiments increases an operating frequency of the compressor 21 to decrease evaporation temperature of the refrigerant in the second heat exchanger 26 and enhance water cooling performance of the second heat exchanger 26 when temperature of the cooling target increases and temperature of water at the water outlet 26*d* reaches or exceeds set temperature (target temperature) of the water. The control device 50 executing such control of the compressor 21 is in an operating mode hereinafter called a "first operating mode" or a "second operating mode".

The first operating mode and the second operating mode are different from each other in acceleration upon increasing the operating frequency of the compressor 21. Specifically, the first operating mode causes the operating frequency of the compressor 21 to be increased by first acceleration, whereas the second operating mode causes the operating frequency to be increased by second acceleration higher than the first acceleration. The first operating mode is effected during steady operation, whereas the second operating mode is effected when the cooling equipment is increased in load. The first operating mode or the second operating mode is selected and effected in accordance with a degree of temperature increase of water at the water inlet 26*c*, in other words, increasing temperature of water per predetermined time. Specifically, the first operating mode is selected when the increasing temperature of water is small per predetermined time, and the second operating mode is selected when the increasing temperature of water is large per predetermined time.

The control device 50 according to one or more embodiments decreases the operating frequency of the compressor 21 to increase the evaporation temperature of the refrigerant in the second heat exchanger 26 and suppress water cooling performance of the second heat exchanger 26 when temperature of the cooling target decreases and temperature of water at the water outlet 26*d* is less than the set temperature (target temperature) of the water. The control device 50 executing such control of the compressor 21 is in an operating mode hereinafter called a "third operating mode". Similar to the first operating mode, the third operating mode is effected during steady operation.

Figure 4:
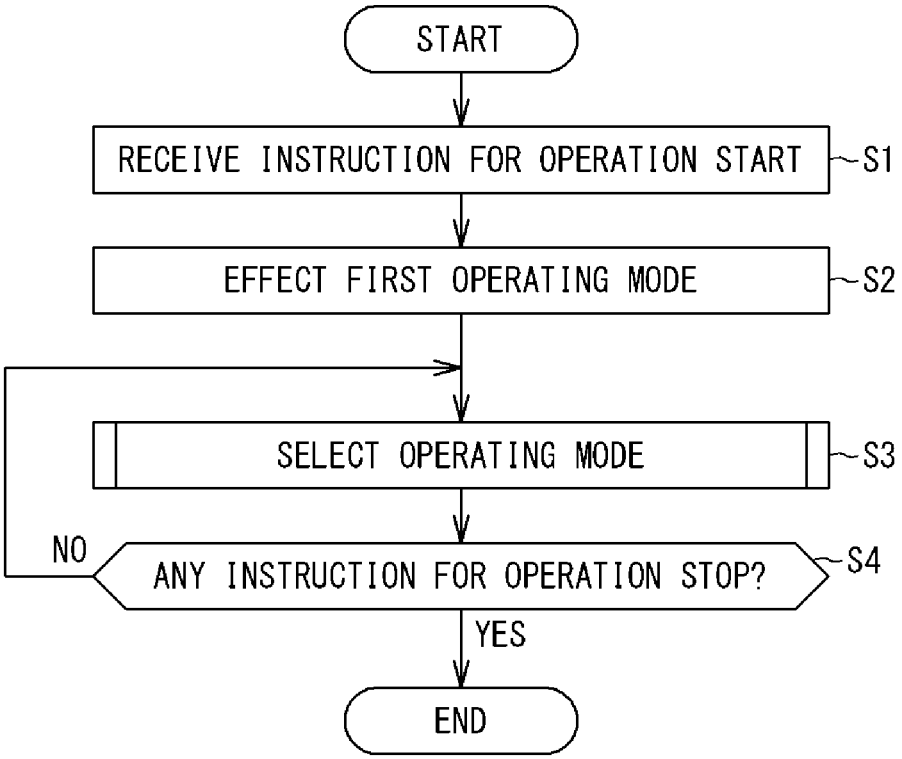
FIG. 4 is a flowchart depicting a procedure for operation control of a chiller apparatus by the control device.

Description is made hereinafter to operation control of the chiller apparatus 10 by the control device 50, inclusive of such control of the compressor 21. FIG. 4 is a flowchart depicting a procedure for operation control of the chiller apparatus 10 by the control device 50.

When receiving an instruction for an operation start (step S1), the control device 50 actuates the compressor 21 under control in the first operating mode (step S2). When the compressor 21 operates stably in the first operating mode (e.g. after elapse of predetermined time), the control device 50 subsequently executes operating mode selection for compressor control, and effects an operating mode thus selected (step S3). The control device 50 then repetitively executes operating mode selection and continues operating until receiving an instruction for an operation stop of the chiller apparatus 10 (step S4).

Figure 5:
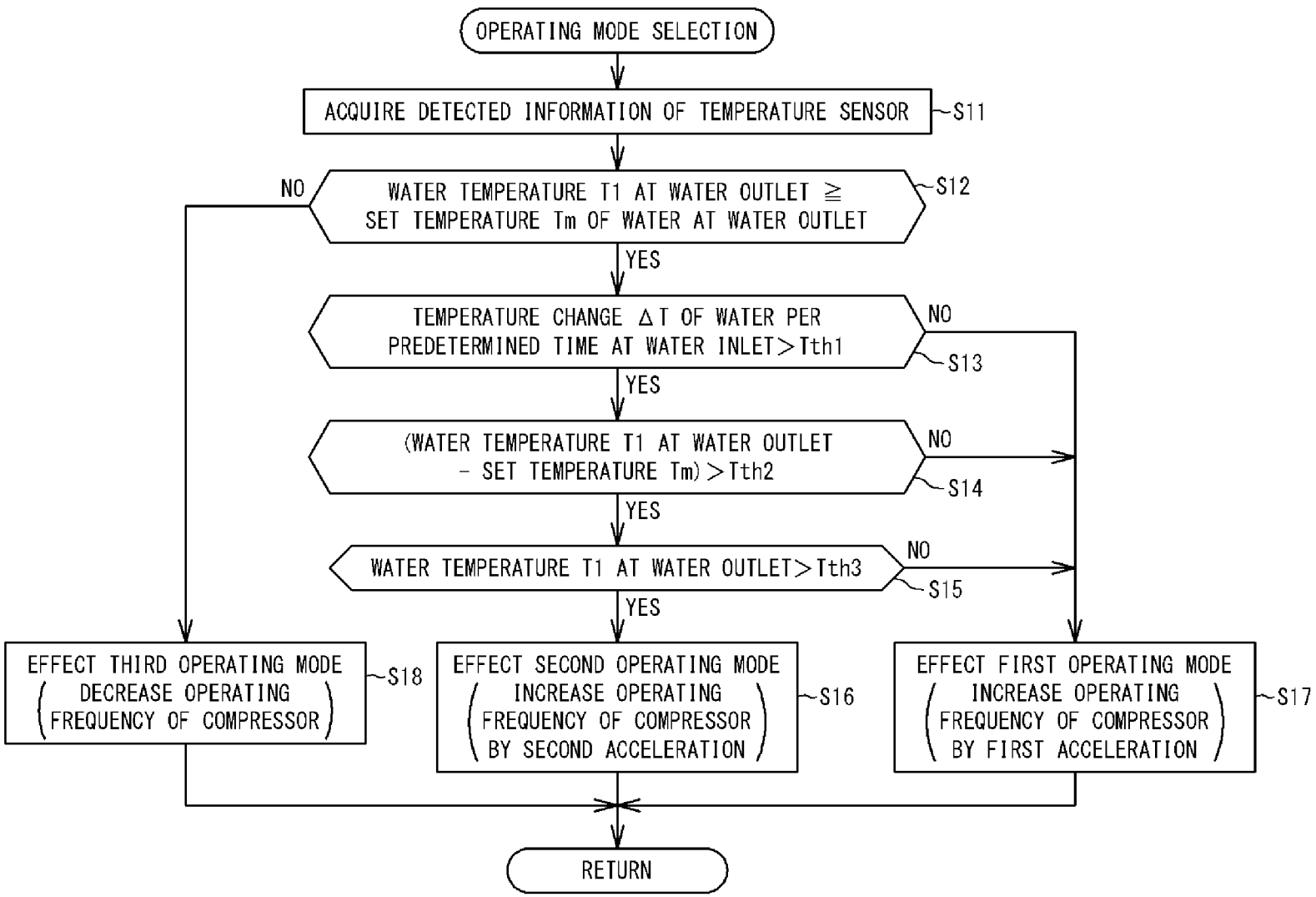
FIG. 5 is a flowchart depicting a procedure for operating mode selection.

FIG. 5 is a flowchart depicting a procedure for operating mode selection. Step S3 in FIG. 4 is executed in accordance with the procedure depicted in FIG. 5.

In the chiller apparatus 10 according to one or more embodiments, the outdoor air temperature sensor 30 detects outdoor air temperature, the refrigerant temperature sensor 31 detects temperature of the refrigerant in the second heat exchanger 26, and each of the outlet temperature sensor 33 and the inlet temperature sensor 32 detects temperature of water in the second heat exchanger 26. Information thus detected is transmitted to the control device 50 (step S11 in FIG. 5).

In step S12, the control device 50 determines whether or not the outlet temperature sensor 33 has detected temperature T1 equal to or more than set temperature (target temperature) Tm of water at the water outlet 26*d*. If determination in step S12 is positive (Yes), the control device 50 forwards processing to step S13. If the determination in step S12 is negative (No), the control device 50 forwards processing to step S18.

If the detected temperature of the outlet temperature sensor 33 is less than the set temperature (target temperature) of water at the water outlet 26*d*, the control device 50 effects the third operating mode in step S18. In the third operating mode, the control device 50 controls to decrease the operating frequency of the compressor 21. The third operating mode is effected because there is no need to further decrease temperature of water when the detected temperature of the outlet temperature sensor 33 is less than the set temperature.

When the detected temperature of the outlet temperature sensor 33 is more than the set temperature (target temperature) of water at the water outlet 26*d*, in step S13, the control device 50 obtains temperature change (increasing temperature) ΔT of water per predetermined time at the water inlet 26*c*, and determines whether or not the temperature change ΔT is more than a predetermined first threshold $T_{th1}$.

The temperature change ΔT corresponds to a difference obtained by subtracting temperature of water at the water inlet 26*c* detected before the predetermined time from temperature of water at the water inlet 26*c* detected by the inlet temperature sensor 32. The temperature change ΔT has a positive value if the cooling target is gradually increased in temperature and the increase influences water temperature. The first threshold $T_{th1}$ in step S13 also has a positive value.

The temperature change ΔT may exemplarily correspond to a difference (° C./minute) between current detected temperature of the inlet temperature sensor 32 and detected temperature of the inlet temperature sensor 32 one minute before. The first threshold $T_{th1}$ can be exemplarily set in a range $1 \leq T_{th1} \leq 2$ (° C./minute).

In a case where the temperature change ΔT is more than the first threshold $T_{th1}$, temperature of water at the water inlet 26*c* is assumed to increase rapidly. Accordingly, water may be quickly cooled. In another case where the temperature change ΔT is equal to or less than the first threshold $T_{th1}$, temperature of water at the water inlet 26*c* is assumed to increase relatively mildly. There is accordingly small necessity to quickly cool water.

If determination in step S13 is positive (Yes), the control device 50 forwards processing to step S14. If the determination in step S13 is negative (No), the control device 50 forwards processing to step S17. In step S17, the control device 50 effects the first operating mode, increases the operating frequency of the compressor 21 by first acceleration, and enhances water cooling performance of the second heat exchanger 26.

In step S14, the control device 50 determines whether or not a difference between the temperature T1 of water at the water outlet 26*d* and the set temperature Tm of water exceeds a predetermined second threshold $T_{th2}$. Such determination is executed because there is small necessity to quickly cool water if the difference between the temperature T1 and the set temperature Tm of water is less than a predetermined value even when the determination in step S13 is positive and water may be quickly cooled from such a viewpoint. If determination in step S14 is positive (Yes), the control device 50 forwards processing to step S15. If the determination in step S14 is negative (No), the control device 50 forwards processing to step S17. As described above, the control device 50 effects the first operating mode in step S17.

In step S15, the control device 50 determines whether or not the temperature T1 of water at the water outlet 26*d* exceeds a predetermined third threshold $T_{th3}$. Such determination is executed because there is small necessity to quickly cool water if the temperature T1 of water at the water outlet 26*d* is less than a predetermined value as in an exemplary case where temperature of water is less than lower limit temperature of the cooling target even when the determination in step S13 and determination in step S14 are positive and water may be quickly cooled from such viewpoints. If determination in step S15 is positive (Yes), the control device 50 forwards processing to step S16. If the determination in step S15 is negative (No), the control device 50 forwards processing to step S17. As described above, the control device 50 effects the first operating mode in step S17.

In step S16, the operating frequency of the compressor 21 is increased by second acceleration, and water cooling performance is quickly enhanced in the second heat exchanger 26. The second acceleration is exemplarily from 1.5 times to 2.5 times the first acceleration, and may be twice. When the control device 50 effects the second operating mode, time t2 from a start of increase in water temperature to decrease to reach original temperature can be shortened as indicated in FIG. 3. In a use condition where the cooling target has increase and decrease in temperature periodically and repetitively, it is accordingly possible to shorten such a cycle.

As described above, when the cooling target has rapid temperature increase as indicated in FIG. 3, the control device 50 according to one or more embodiments selects and effects an operating mode in accordance with water temperature at the water inlet 26*c* rapidly increasing to follow the temperature increase of the cooling target. It is accordingly possible to quickly decrease water temperature without freezing the second heating medium in the second heat exchanger 26, and cool the cooling target in short time.

The control device 50 selects and effects an operating mode in accordance with the procedure described above, and repeats a similar procedure until the chiller apparatus 10 is stopped (step S3 in FIG. 4).

According to the procedure depicted in FIG. 5, similar processing is repeated regardless of which one of the first to third operating modes is effected before step S11. The present disclosure should not be limited to such a case. An operating mode may be selected through processing different from the above upon transition from a specific operating mode to a different operating mode as exemplarily depicted in FIG. 6.

[Different Procedure for Operating Mode Selection]

Figure 6:
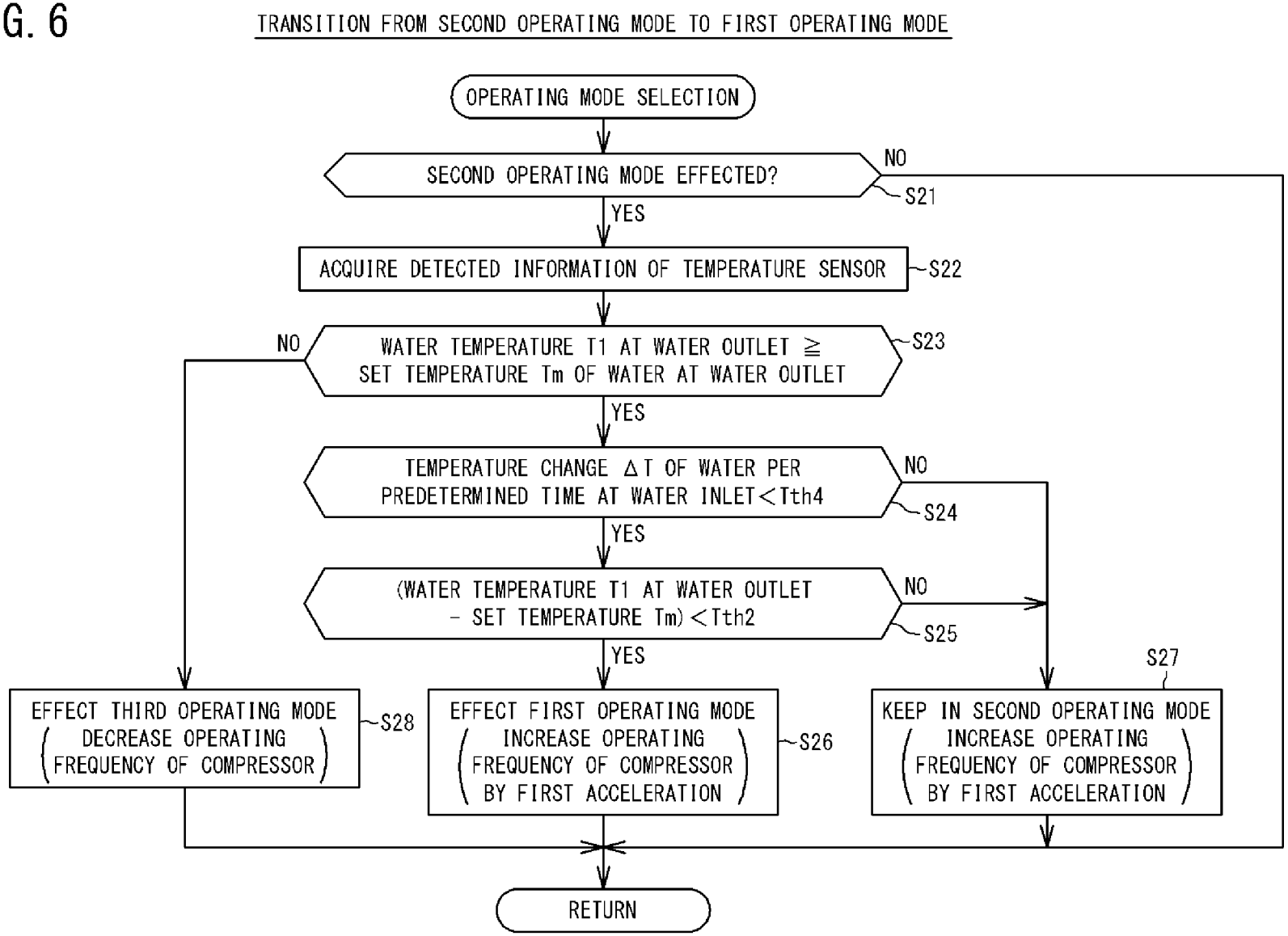
FIG. 6 is a flowchart depicting a different procedure for operating mode selection.

FIG. 6 is a flowchart depicting a different procedure for operating mode selection.

The procedure depicted in FIG. 6 is applicable after the second operating mode is selected in accordance with the procedure depicted in FIG. 5. Accordingly, the control device 50 determines whether or not the second operating mode is effected in step S21 of FIG. 6. If such determination is positive (Yes), the control device 50 forwards processing to step S22. If the determination is negative (No), the control device 50 ends processing and forwards in accordance with the procedure depicted in FIG. 5.

In step S22, the control device 50 acquires detected temperature from each of the temperature sensors 31 to 33. In step S23, the control device 50 determines whether or not the detected temperature T1 of the outlet temperature sensor 33 is equal to or more than the set temperature (target temperature) Tm of water at the water outlet 26*d*. If determination in step S23 is positive (Yes), the control device 50 forwards processing to step S24. If the determination in step S23 is negative (No), the control device 50 forwards processing to step S28.

If the detected temperature of the outlet temperature sensor 33 is less than the set temperature (target temperature) of water at the water outlet 26*d*, the control device 50 effects the third operating mode in step S28 as in the procedure (in step S18) depicted in FIG. 5.

When the detected temperature of the outlet temperature sensor 33 is more than the set temperature (target temperature) of water at the water outlet 26*d*, in step S24, the control device 50 obtains the temperature change ΔT of water per predetermined time at the water inlet 26*c*, and determines whether or not the temperature change ΔT is equal to or less than a predetermined fourth threshold $T_{th4}$. The fourth threshold $T_{th4}$ is less than the first threshold $T_{th1}$.

If temperature of water at the water inlet 26*c* is gradually decreasing, the temperature change ΔT is less than 0° C. The fourth threshold $T_{th4}$ according to one or more embodiments can be set to be less than 0° C., and exemplarily satisfy $-1<T_{th4}<0$ (° C./minute), and can further be set to −0.5 (° C./minute). Upon satisfaction of a condition in step S24, temperature of water at the water inlet 26*c* is assumed to be gradually decreasing. Accordingly, water may be mildly cooled. The fourth threshold $T_{th4}$ may alternatively have zero or a positive value.

If determination in step S24 is positive (Yes), the control device 50 forwards processing to step S25. If the determination in step S24 is negative (No), the control device 50 forwards processing to step S27. In step S27, the control device 50 continuously effects the second operating mode, increases the operating frequency of the compressor 21 by the second acceleration, and enhances water cooling performance of the second heat exchanger 26.

In step S25, the control device 50 determines whether or not the difference between the temperature T1 of water at the water outlet 26*d* and the set temperature Tm of water is less than the predetermined second threshold $T_{th2}$. Such determination is executed because there is large necessity to quickly cool water if the difference between the temperature T1 and the set temperature Tm of water is more than the predetermined value even when the determination in step S24 is positive and water may be mildly cooled from such a viewpoint. If determination in step S25 is positive (Yes), the control device 50 forwards processing to step S26. If the determination in step S25 is negative (No), the control device 50 forwards processing to step S27. As described above, the control device 50 continuously effects the second operating mode in step S27.

In step S26, the control device 50 effects the first operating mode. In other words, the control device 50 controls to switch from the second operating mode to the first operating mode. The control device 50 accordingly increases the operating frequency of the compressor 21 by the first acceleration lower than the second acceleration, and mildly enhances water cooling performance of the second heat exchanger 26.

In accordance with the procedure depicted in FIG. 6, there is no need to quickly decrease water temperature when water temperature in the second heat exchanger 26 stops increasing and decreases during operation in the second operating mode. It is thus possible to transition from the second operating mode to the first operating mode and moderate decrease in water temperature.

Other Embodiments

In step S2 after receipt of the instruction for an operation start in the procedure depicted in FIG. 4, the control device 50 may initially activate the compressor 21 through control in the second operating mode and then control to transition to the first operating mode after operation is stabilized. As in the above embodiments, processing in initial step S3 starts in the first operating mode also in this case.

The procedure depicted in FIG. 5 can exclude any one of or both step S14 and step S15 from processing from step S13 to step S15 for selection of the first operating mode or the second operating mode. The procedure depicted in FIG. 6 can exclude step S25 for selection of the first operating mode or the second operating mode.

In step S13 depicted in FIG. 5 and step S24 depicted in FIG. 6, the control device 50 compares the temperature change ΔT of water per predetermined time at the water inlet 26*c* with the predetermined threshold $T_{th1}$ and the predetermined threshold $T_{th4}$, respectively. Alternatively, temperature change of water per predetermined time at the water outlet 26*d* acquired with use of the outlet temperature sensor 33 may be compared with the predetermined threshold.

The second heating medium should not be limited to water, but may alternatively be any other heating medium such as brine.

Action and Effects of Embodiments

When the cooling target is rapidly increased in temperature, the refrigeration apparatus described above is required to increase an operating frequency of the compressor in order to inhibit deterioration in cooling efficiency. However, water is not readily increased in temperature even when the cooling target or the like is increased in temperature. Accordingly, if the operating frequency of the compressor is increased in accordance with temperature increase of the cooling target, water may be cooled excessively to be frozen in the second heat exchanger. Therefore, one or more embodiments of the present disclosure provide a refrigeration apparatus configured to quickly cool a cooling target appropriately.

(Action and Effects)

(1) The refrigeration apparatus according to the above embodiments includes the compressor 21, the first heat exchanger 23 configured to allow the first heating medium such as the refrigerant compressed by the compressor 21 to flow therein and radiate heat of the first heating medium, the second heat exchanger 26 configured to allow the first heating medium having passed the first heat exchanger 23 and the second heating medium such as water provided to cool the cooling target to flow therein and cause heat exchange between the first heating medium and the second heating medium, the temperature sensor (first temperature sensor) 32, 33 configured to detect temperature of the second heating medium in the second heat exchanger 26, and the control device 50 configured to control the operating frequency of the compressor 21. Upon satisfaction of a condition (first condition) where the increasing temperature ΔT of the second heating medium per predetermined time in the second heat exchanger 26 is equal to or less than the first threshold $T_{th1}$ as depicted in step S13 in FIG. 5, the control device 50 effects the first operating mode for changing the operating frequency of the compressor 21 by the first acceleration. Upon satisfaction of a condition (second condition) where the increasing temperature ΔT of the second heating medium per predetermined time in the second heat exchanger 26 exceeds the first threshold $T_{th1}$, the control device 50 effects the second operating mode for changing the operating frequency of the compressor 21 by the second acceleration higher than the first acceleration. In an exemplary case where the cooling target is rapidly increased in temperature during operation in the first operating mode, operation can thus be switched from the first operating mode to the second operating mode not in accordance with the temperature of the cooling target but in accordance with the temperature of the second heating medium rapidly increasing after the temperature increase of the cooling target. It is accordingly possible to quickly decrease temperature of the second heating medium without freezing the second heating medium in the second heat exchanger 26, and cool the cooling target in short time.

(2) The first temperature sensor according to the above embodiments corresponds to the inlet temperature sensor 32 configured to detect temperature of the second heating medium at the inlet 26*c* of the second heating medium in the second heat exchanger 26. The temperature of the second heating medium at the inlet 26*c* of the second heating medium in the second heat exchanger 26 reflects temperature increase of the cooling target. It is accordingly possible to effect the second operating mode at more appropriate timing.

(3) The refrigeration apparatus according to the above embodiments further includes the outlet temperature sensor 33 configured to detect temperature of the second heating medium at the outlet 26*d* of the second heating medium in the second heat exchanger 26. The control device 50 switches from the first operating mode to the second operating mode upon satisfaction of the second condition and satisfaction of a condition (third condition) where the difference obtained by subtracting the set temperature of the second heating medium from the detected temperature of the outlet temperature sensor 33 exceeds the second threshold $T_{th2}$ during operation in the first operating mode as in step S14 depicted in FIG. 5. When the temperature at the outlet 26*d* of the second heating medium in the second heat exchanger 26 is not high enough to exceed the predetermined value (second threshold $T_{th2}$) relatively to the set temperature (when the third condition is not satisfied), the second operating mode is not effected even upon satisfaction of the second condition, to inhibit freezing of the second heating medium and excessive cooling of the cooling target.

(4) The refrigeration apparatus according to the above embodiments further includes the outlet temperature sensor (second temperature sensor) 33 configured to detect temperature of the second heating medium at the outlet 26*d* of the second heating medium in the second heat exchanger 26. The control device 50 switches from the first operating mode to the second operating mode upon satisfaction of the second condition and satisfaction of a condition (fourth condition) where the detected temperature of the outlet temperature sensor 33 exceeds the third threshold $T_{th3}$ during operation in the first operating mode as in step S15 depicted in FIG. 5.

When the temperature at the outlet 26*d* of the second heating medium in the second heat exchanger 26 is less than the third threshold $T_{th3}$ (e.g. the lower limit temperature of the cooling target), in other words, when the fourth condition is not satisfied, the second operating mode is not effected even upon satisfaction of the second condition, to inhibit freezing of the second heating medium and excessive cooling of the cooling target.

(5) The second acceleration according to the above embodiments is from 1.5 times to 2.5 times the first acceleration. The second heating medium having rapidly increased in temperature can thus be cooled efficiently.

(6) The control device 50 according to the above embodiments switches from the second operating mode to the first operating mode upon satisfaction of a condition (fifth condition) where the temperature change ΔT per predetermined time of the second heating medium in the second heat exchanger 26 is equal to or less than the fourth threshold $T_{th4}$ that is less than the first threshold $T_{th1}$ during operation in the second operating mode as in step S24 depicted in FIG. 6. There is no need to quickly decrease temperature of the second heating medium when the temperature of the second heating medium in the second heat exchanger 26 stops increasing and decreases during operation in the second operating mode. It is thus possible to transition from the second operating mode to the first operating mode and moderate decrease in temperature of the second heating medium.

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

10 chiller apparatus (refrigeration apparatus)
21 compressor
23 first heat exchanger
26 second heat exchanger
26*c* water inlet
26*d* water outlet

32 inlet temperature sensor
33 outlet temperature sensor
50 control device
T1 temperature
T1 detected temperature
Tm set temperature
$T_{th1}$ first threshold
$T_{th2}$ second threshold
$T_{th3}$ third threshold
$T_{th4}$ fourth threshold
t2 time
ΔT temperature change

What is claimed is:

1. A refrigeration apparatus comprising:
a compressor;
a first heat exchanger that allows a first heating medium compressed by the compressor to flow therein and to radiate heat of the first heating medium;
a second heat exchanger that:
allows the first heating medium having passed the first heat exchanger and a second heating medium cooling a cooling target to flow therein, and
causes heat exchange between the first heating medium and the second heating medium;
a first temperature sensor that detects temperature of the second heating medium in the second heat exchanger; and
a control device that controls an operating frequency of the compressor, wherein
the control device:
causes the compressor to operate in a first operating mode that changes the operating frequency by first acceleration,
determines a rate of increase in the temperature, detected by the first temperature sensor, per first predetermined time, and
switches operation of the compressor from the first operating mode to a second operating mode that changes the operating frequency by second acceleration higher than the first acceleration in response to determining that the rate of the increase in the temperature per the first predetermined time has exceeded a first temperature rate threshold.

2. The refrigeration apparatus according to claim 1, wherein the first temperature sensor detects temperature of the second heating medium at an inlet of the second heating medium in the second heat exchanger.

3. The refrigeration apparatus according to claim 1, the refrigeration apparatus further comprising:
a second temperature sensor that detects temperature of the second heating medium at an outlet of the second heating medium in the second heat exchanger, wherein
during operation of the compressor in the first operating mode, the control device:
determines a difference obtained by subtracting set temperature of the second heating medium from detected temperature of the second temperature sensor, and
switches operation of the compressor from the first operating mode to the second operating mode in response to determining that the difference has exceeded a temperature difference threshold.

4. The refrigeration apparatus according to claim 1, further comprising:
a second temperature sensor that detects temperature of the second heating medium at an outlet of the second heating medium in the second heat exchanger, wherein
during operation of the compressor in the first operating mode, the control device:
determines detected temperature of the second temperature sensor, and
switches operation of the compressor from the first operating mode to the second operating mode in response to determining that the detected temperature of the second temperature sensor has exceeded a temperature threshold.

5. The refrigeration apparatus according to claim 1, wherein the second acceleration is from 1.5 times to 2.5 times the first acceleration.

6. The refrigeration apparatus according to claim 1, wherein, during operation of the compressor in the second operating mode, the control device:
determines temperature change of the second heating medium in the second heat exchanger, detected by the first temperature sensor, per second predetermined time, and
switches operation of the compressor from the second operating mode to the first operating mode in response to determining the temperature change per the second predetermined time has been equal to or less than a second temperature rate threshold that is less than the first temperature rate threshold.

* * * * *